US007503796B2

(12) United States Patent
Luettermann et al.

(10) Patent No.: US 7,503,796 B2
(45) Date of Patent: Mar. 17, 2009

(54) CARD EDGE CONNECTOR WITH A GUIDE SPRING FOR PRECISE CONTACT GUIDANCE OF A PCB

(75) Inventors: Dieter Luettermann, Rahden (DE); Guenter Pape, Enger (DE)

(73) Assignee: Harting Electronics GmbH & Co. KG, Espelkamp (DE)

( * ) Notice: Subject to any disclaimer, the term of this patent is extended or adjusted under 35 U.S.C. 154(b) by 0 days.

(21) Appl. No.: 11/565,859

(22) Filed: Dec. 1, 2006

(65) Prior Publication Data

US 2007/0141884 A1 Jun. 21, 2007

(30) Foreign Application Priority Data

Dec. 21, 2005 (DE) ..... 10 2005 061 166

(51) Int. Cl.
*H01R 13/64* (2006.01)

(52) U.S. Cl. ..... 439/377

(58) Field of Classification Search ..... 439/260, 439/267, 269.1, 269.2, 377, 640, 66
See application file for complete search history.

(56) References Cited

U.S. PATENT DOCUMENTS 4,025,147 A * 5/1977 Van Arsdale et al. ..... 439/634
5,308,257 A * 5/1994 Buchter et al. ..... 439/267
5,389,000 A * 2/1995 DiViesti et al. ..... 439/157
5,531,615 A * 7/1996 Irlbeck et al. ..... 439/631
5,676,555 A * 10/1997 Yu et al. ..... 439/157
5,769,668 A * 6/1998 Tondreault ..... 439/633
5,820,392 A * 10/1998 Lin et al. ..... 439/108
5,853,303 A * 12/1998 Brunker et al. ..... 439/637
5,897,390 A * 4/1999 Yamagami et al. ..... 439/326
6,080,000 A * 6/2000 Baker et al. ..... 439/326
6,227,898 B1 * 5/2001 Meng et al. ..... 439/377
6,652,322 B2 * 11/2003 Ito et al. ..... 439/637
6,767,232 B1 * 7/2004 Tien ..... 439/159
6,773,285 B2 * 8/2004 Bernat et al. ..... 439/246

FOREIGN PATENT DOCUMENTS

JP 2002343466 11/2002
WO WO 02/091522 11/2002

* cited by examiner

*Primary Examiner*—Chandrika Prasad
(74) *Attorney, Agent, or Firm*—Hayes Soloway P.C.

(57) ABSTRACT

Precise contact guidance of contact decks on a printed circuit board relative to the electric contacts in a card edge connector, is achieved using a pressing spring within the slot of the card edge connector in such a way that it mechanically deflects the mating region of the printed circuit board into a position in which a precisely fitted coincidence of the respective contacts is expected before the electric contacting takes place.

12 Claims, 4 Drawing Sheets

CARD EDGE CONNECTOR WITH A GUIDE SPRING FOR PRECISE CONTACT GUIDANCE OF A PCB

BACKGROUND OF THE INVENTION

1. Field of the Invention

The invention pertains to a device for the precise contact guidance of contact decks on a printed circuit board relative to electric contacts in a card edge connector, as well as to a device for the precise contact guidance of contact decks on a connector adapter relative to electric contacts in a card edge connector.

A device of this type is required for ensuring a mechanically exact guidance of contact decks arranged on a printed circuit board relative to the electric contacts arranged in a card edge connector.

2. Description of the related art

Common direct plug-type connections between printed circuit boards and card edge connectors provided for this purpose have a relatively large contact grid (>1 mm) and therefore cause hardly any tolerance problems between the contacts on the printed circuit board and the electric contacts within the connector.

However, if the size of the contact grid is reduced, enhanced precision is required in the manufacture of the printed circuit boards such that the costs are inevitably increased. Otherwise, it would be hardy possible to avoid faulty connections due to the relatively large manufacturing tolerances of conventional printed circuit boards to the more closely aligned positioned contact in the connector.

SUMMARY OF THE INVENTION

The invention consequently is based on the objective of designing a device of the initially cited type in such a way that the best mechanical coincidence possible is achieved between the position of the contacts on the printed circuit board and the contacts in the card edge connector, namely with consideration of the relatively large fault tolerances in the manufacture of printed circuit boards.

This objective is attained in that a pressing spring is arranged in the card edge connector and selectively subjects the mating region of the printed circuit board or the connector adapter to lateral pressure against a lay-on region such that a closely aligned positioning of the contact decks on the printed circuit board and the electric contacts in the card edge connector is achieved.

The advantages attained with the invention can be seen, in particular, in that the relatively large and apparently incorrigible dimensional tolerances in the manufacture of a mating region on a printed circuit board can be minimized with the inventive pressing spring to such a degree that the contact sockets in the card edge connector can also be precisely contacted if they are spaced apart from one another by a small distance. If the strip conductor contacts to be mated with the contact sockets are not precisely positioned, it is unavoidable to prevent faulty connections and, in extreme instances, short-circuits. This is the case, in particular, if the mating region of a printed circuit board is inserted into the slot of a card edge connector and the printed circuit board is not guided in a defined fashion relative to the electric contact, respectively.

Dimensional tolerances also need to be observed in the longitudinal direction of the slot.

However, if the contact spacing is smaller than 1 mm, the manufacturers of printed circuit boards can no longer guarantee the required strict tolerances.

This requires a precise guidance of the printed circuit board in the connector housing, as well as a strict tolerance between at least the first contact deck and its lay-on edge.

The invention proposes to provide the card edge connector with a lay-on region within its slot, wherein a pressure spring that acts toward one side is arranged opposite of said lay-on region.

When the connection is produced, the printed circuit board is inserted into the funnel-shaped slot with its mating region. The mating region is taken hold of by the spring on one of its lateral edges and pressed against the lay-on region on the opposite side of the slot with its lay-on edge. However, the strip conductors on the printed circuit boards and the contact sockets in the connector body are not yet contacted at this point.

The corresponding contact is only produced during the additional insertion of the printed circuit board and along the lay-on region, during which the lateral spring pressure is preserved.

Since the dimensional tolerance between the lay-on edge and the first contact deck is significantly smaller than the dimensional tolerance between the lay-on edge and the opposite edge of the mating region and the spacings between the individual contact decks are also subject to relatively strict tolerances, the pressure of the spring advantageously ensures the precise guidance of the contact decks to the contact sockets.

In this case, the pressing spring does not have to be realized in the form of a separate metallic spring, but may also consist of a spring that is integrally molded into the insulating member of the card edge connector.

BRIEF DESCRIPTION OF THE DRAWINGS

One embodiment of the invention is illustrated in the figures and described in greater detail below. The figures show.

DESCRIPTION OF THE PREFERRED EMBODYMENTS

FIG. 1 shows an arrangement of a printed circuit board 1 for producing a direct plug-type connection with a card edge connector 10.

Figure 1B:
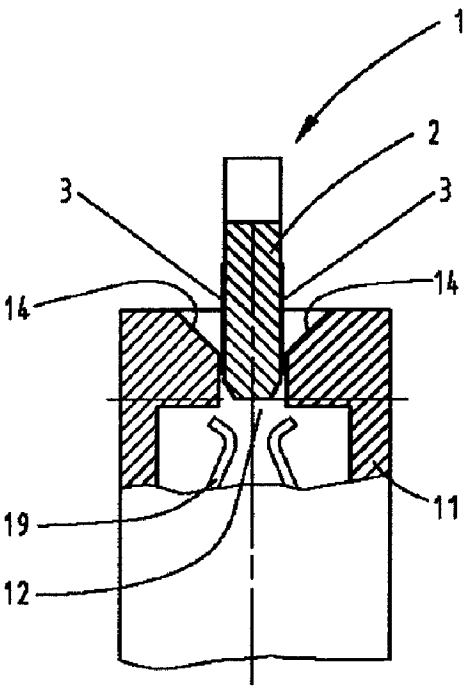
FIG. 1*a* is a projection and FIG. 1*b* a section view of the mating region of a printed circuit board during the insertion into a card edge connector.
Figure 1A:
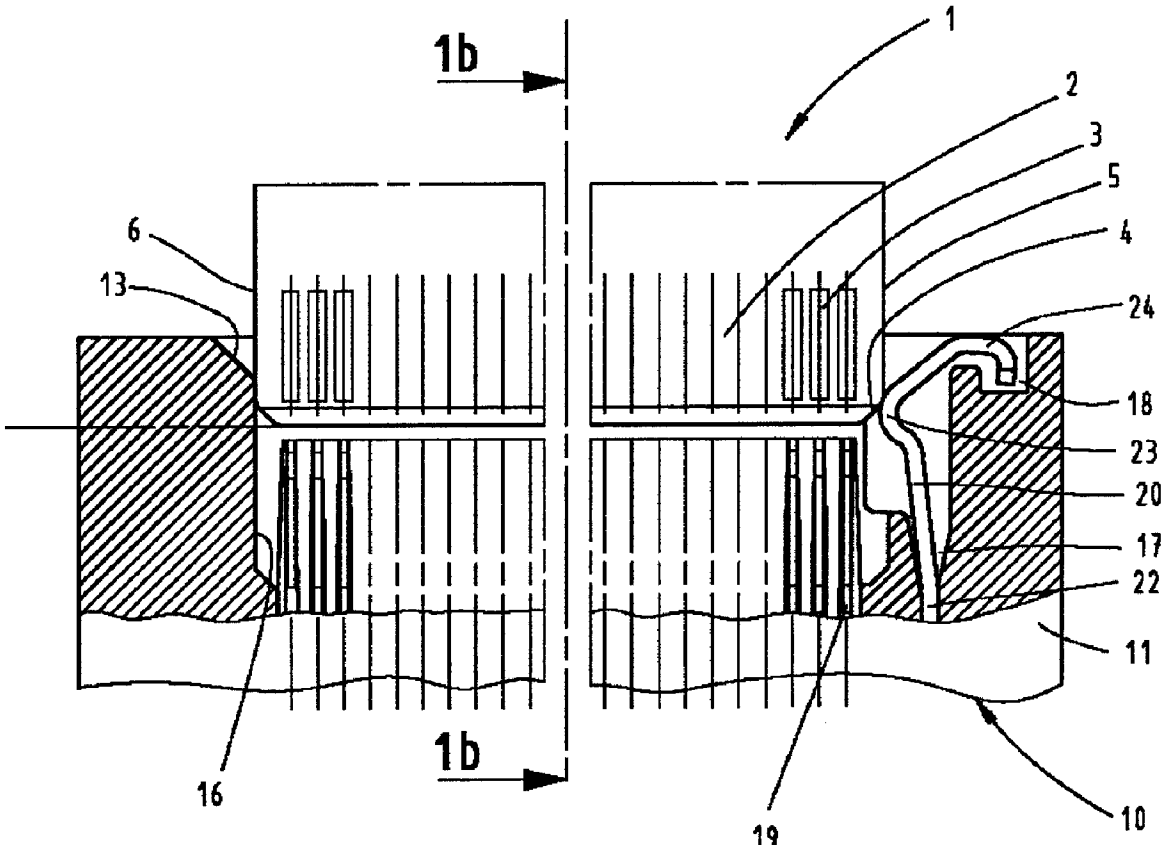

In this case, FIG. 1*a* shows a projection of the printed circuit board 1 with electric contact decks 3 adjacently arranged thereon, as well as the insulating member 11 in which the electric contacts 19 are arranged adjacent to one another. A pressing spring 20 is held in an opening 17 in the insulating member with its spring leg 22, namely on the right side in this case. The pressing spring 20 is initially slightly bent into the mating region in the slot 12 such that a pressing surface in the form of a semicircular bow 23 is formed, wherein the pressing spring then extends in the opposite direction at an incline of about 45° referred to the vertical line and ends in a groove 18 in the insulating member of the card edge connector in the form of a hook-shaped end 24. In this case, the width of the groove 18 is adapted to the displacement of the pressing spring such that the hook-shaped end 24 adjoins the housing wall in extreme instances.

When inserting the printed circuit board into the slot 12 of the socket connector according to FIG. 1*a*, the mating region 2 initially comes in contact with the bow 23 of the pressing spring 20 with the lateral bevel 4 and subsequently with the lateral edge 5. This means that the pressing spring presses against the lateral edge 5 in such a way that the mating region is ultimately pressed against the lay-on region 16 with the opposite lay-on edge 6. In this case, the pressing spring 20 is perpendicularly arranged in an opening 17 on the right side of the slot 12.

FIG. 1*b* shows a section transverse to the mating region, in which the printed circuit board is inserted into a funnel-shaped opening 14 of the slot 12 in the direction of tulip-shaped contacts 19 with its mating region 2. This ensures that the contacts applied on the printed circuit board are initially aligned with the electric contacts arranged in the socket connector housing and exactly and precisely contacted with one another during the additional insertion.

Figure 2B:
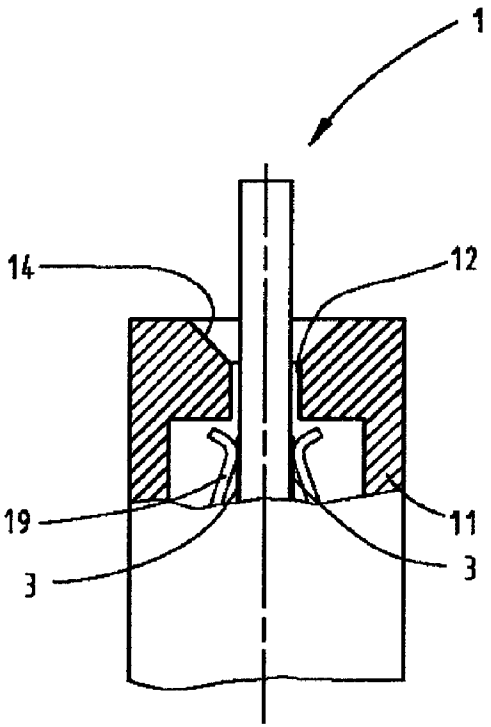
FIG. 2*a* is a projection and FIG. 2*b* a section view of the mating region of a printed circuit board that is mated with a card edge connector.
Figure 2A:
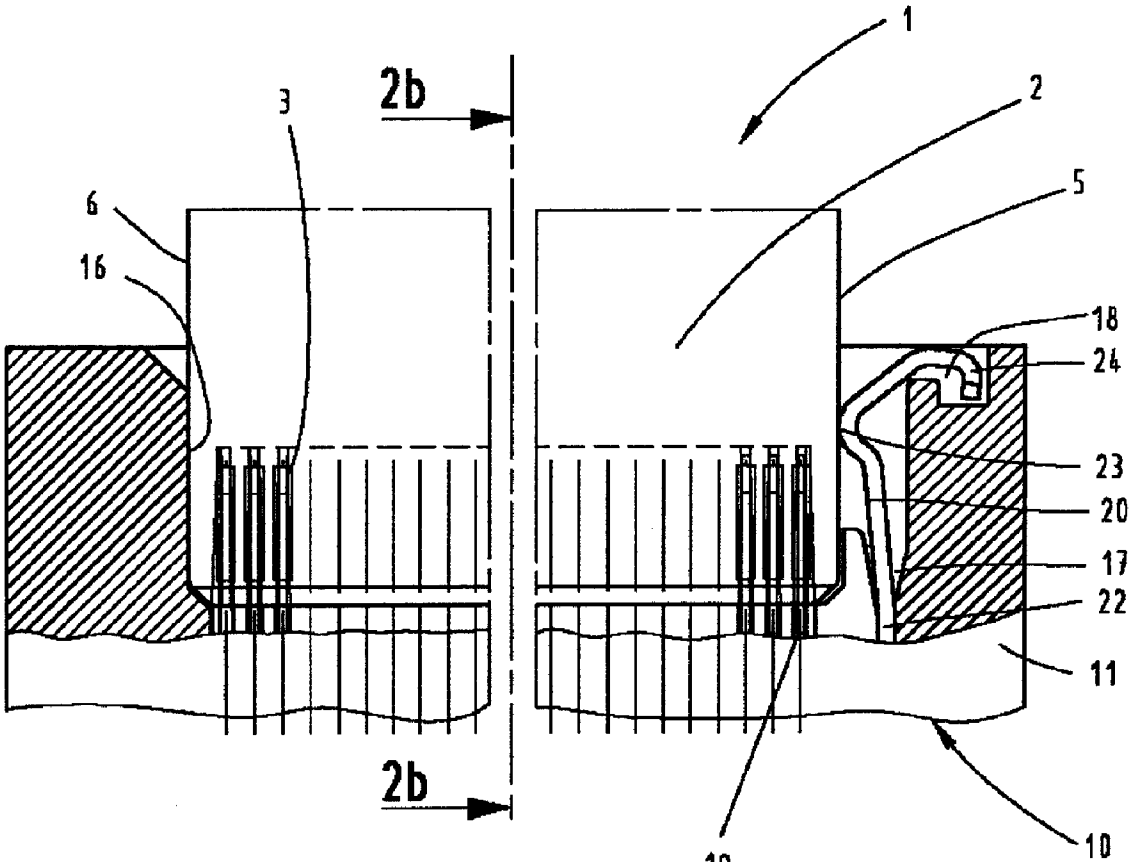

FIG. 2 shows the additional insertion and the printed circuit board when it is completely inserted into the card edge connector. The mating region 2 of the printed circuit board 1 solidly adjoins the lay-on region 16 with the lay-on edge 6 due to the pressure exerted by the pressing spring 20 such that the electric contacts 19 are closely aligned contacted with the contact decks 3 on the printed circuit board.

Figure 3B:
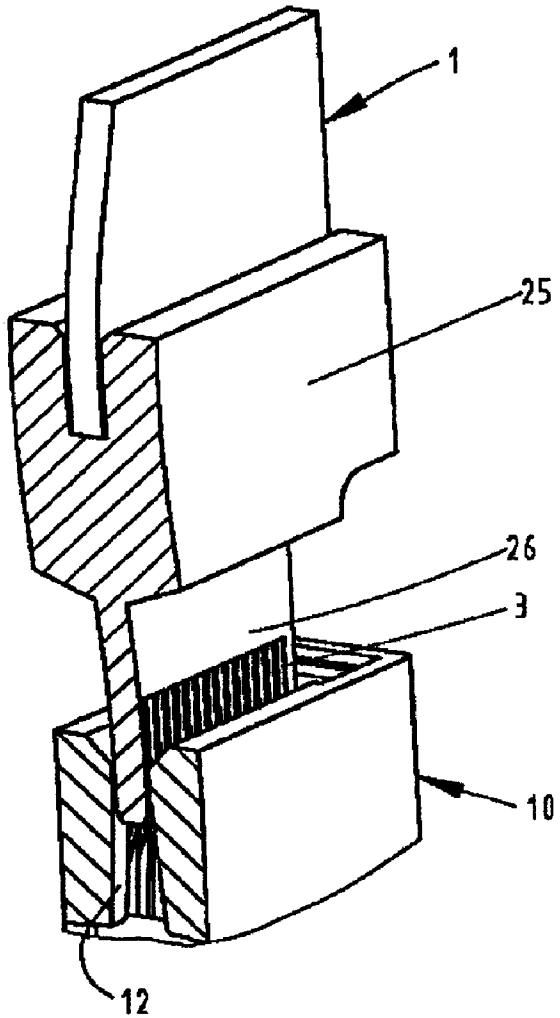
FIG. 3*a* is a projection and FIG. 3*b* a perspective of a printed circuit board with a connector adapter during the insertion into the card edge connector.
Figure 3A:
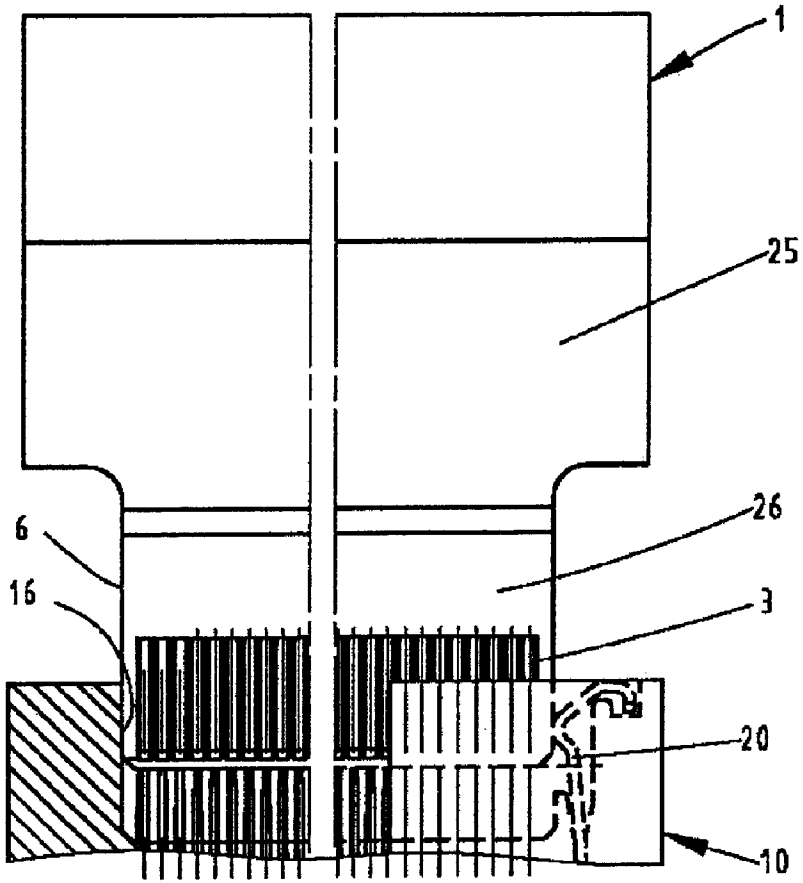

FIGS. 3*a, b* show a connector variation, in which the printed circuit board 1 is solidly connected to a connector adapter 25, the mating side 26 of which is designed such that it can also be inserted into the slot 12 of the above-described card edge connector 10.

In this case, FIG. 3*a* shows a projection of the mated adapter variation with a partial section of the card edge connector, and FIG. 3*b* shows a perspective representation with a longitudinal section through the connector variation.

Although the manufacture of such a connector is carried out in a much more precise fashion with respect to the dimensional tolerances, the shape is adapted to the above-described printed circuit board such that a printed circuit board can be inserted into the card edge connector 10 in a precisely fitted fashion with or without the special connector adapter with the pressing spring 20.

Figure 4:
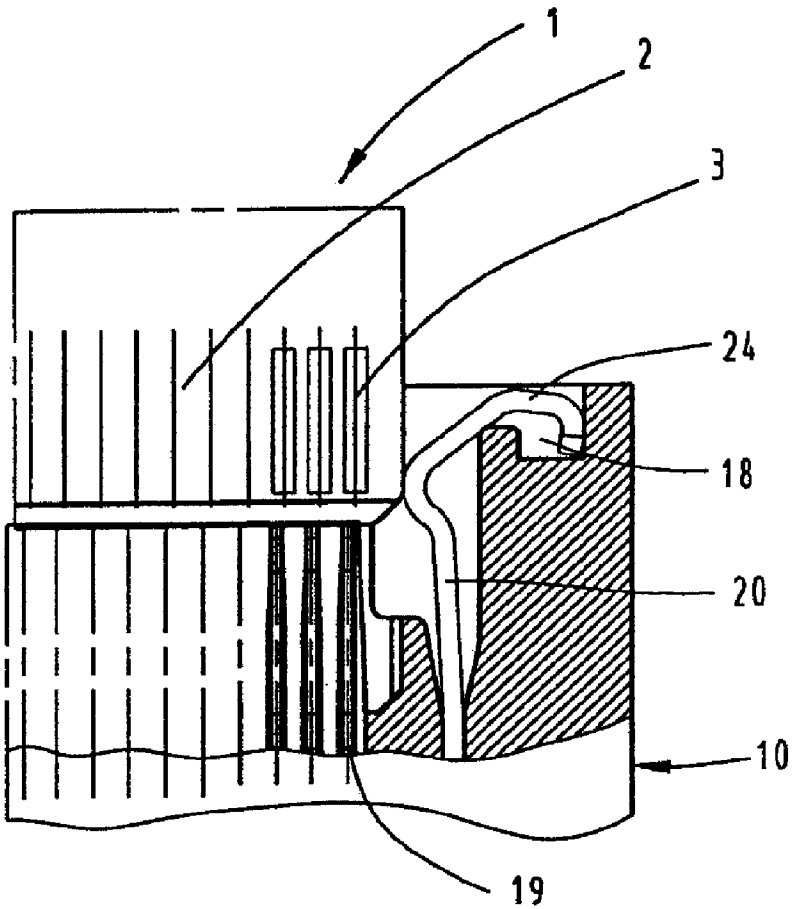
FIG. 4 is a detail in which the printed circuit board is extremely misaligned relative to the card edge connector.

FIG. 4 shows an extreme misalignment between the contact decks 3 on the printed circuit board 1 and the electric contacts 19 in the card edge connector 10 in the form of a detail. This figure shows the situation in the instant in which the mating region 2 of the printed circuit board is inserted into the slot 8 in such an offset fashion that the pressing spring 16 is subjected to an extreme deflection and contacts the boundary in the groove 13 with the hook-shaped end 18. The pressing spring 16 has the function of positioning the mating region 2 against the lay-on region 16 during the mating process and before the contacting of the electric contacts, namely such that a precisely fitted coincidence of the respective contacts is ensured and the printed circuit board is subsequently additionally inserted until its stop is reached.

What is claimed is:

1. A device for the precise contact guidance of contact decks on a printed board with a mating region relative to electric contacts in a card edge connector, wherein said printed circuit board is provided with lateral bevels on both sides of the mating region, said device comprising:

a pressing spring arranged on one side in an opening within a slot of the card edge connector, said pressing spring exerting a force initially on the lateral bevels and then on a flat lateral side during insertion of the printed circuit board into the card edge connector, thereby subjecting the mating region of the printed circuit board to lateral pressure against a lay-on region on an other flat side of the printed circuit board, before the circuit printed board is completely inserted in the slot, such that the contact decks on the printed circuit board are closely aligned and positioned relative to the electric contacts in the card edge connector, when the circuit printed board is completely inserted in the slot.

2. The device according to claim 1, wherein the pressing spring is laterally arranged in the slot of the card edge connector and presses against a lateral edge of the mating region of the printed circuit board, wherein the opposite lay-on edge of the mating region adjoins a lay-on region.

3. The device according to claim 2, wherein the pressing spring arranged within the slot is formed as a separate element or an integrally molded element of the card edge connector.

4. The device according to claim 1, wherein the pressing spring is arranged within the slot of the card edge connector in the form of a separate element.

5. The device according to claim 1, wherein the pressing spring is arranged within the slot of the card edge connector in the form of an element that is integrally molded thereon.

6. The device according to claim 1, wherein the pressing spring is arranged only on one side of the slot.

7. A device for the precise contact guidance of contact decks on a connector adapter relative to the electric contacts in a card edge connector wherein said connector adapter is provided with lateral bevels on both sides of the contact decks, comprising a pressing spring having an electrically insulated base arranged in a slot of the card edge connector, said pressing spring exerting a force initially on the lateral bevels and then on a flat lateral side of the connector adapter during insertion of the printed circuit board into the card edge connector, thereby pressing a mating side of a connector adapter that is solidly connected to a printed circuit board against the lay-on region situated opposite of the pressing spring during the mating with the card edge connector, wherein the contact decks on the connector adapter are closely aligned with the electric contacts in the card edge connector.

8. The device according to claim 7, wherein the pressing spring is laterally arranged in the slot of the card edge connector and presses against a lateral edge of the connector adapter, wherein the opposite lay-on edge of the mating region adjoins a lay-on region.

9. The device according to claim 8, wherein the pressing spring arranged within the slot is formed as a separate element or an integrally molded element of the card edge connector.

10. The device according to claim 7, wherein the pressing spring is arranged within the slot of the card edge connector in the form of a separate element.

11. The device according to claim 6, wherein the pressing spring is arranged within the slot of the card edge connector in the form of an element that is integrally molded thereon.

12. The device according to claim 7, wherein the pressing spring is arranged only on one side of the slot.

* * * * *